US010478986B2

(12) United States Patent
Ebrahim et al.

(10) Patent No.: US 10,478,986 B2
(45) Date of Patent: Nov. 19, 2019

(54) MANDOLINE SLICER

(71) Applicant: Masterful Limited, North Point (HK)

(72) Inventors: Ali Abdulhusein Ebrahim, North Point (HK); Philip A. Spencer, Queen's Road East (HK)

( * ) Notice: Subject to any disclaimer, the term of this patent is extended or adjusted under 35 U.S.C. 154(b) by 131 days.

(21) Appl. No.: 15/730,764

(22) Filed: Oct. 12, 2017

(65) Prior Publication Data

US 2019/0111579 A1 Apr. 18, 2019

(51) Int. Cl.
*B26D 3/28* (2006.01)
*B26D 7/26* (2006.01)

(52) U.S. Cl.
CPC ..... *B26D 3/283* (2013.01); *B26D 7/2628* (2013.01); *B26D 2003/285* (2013.01); *B26D 2003/287* (2013.01); *B26D 2003/288* (2013.01)

(58) Field of Classification Search
CPC ..... B26D 3/283; B26D 7/2628; B26D 2003/285; B26D 2003/287; B26D 2003/288
See application file for complete search history.

(56) References Cited

U.S. PATENT DOCUMENTS 466,930 A * 1/1892 Yaiser ..... B26D 3/283 83/699.51
772,504 A * 10/1904 Dorsey ..... B26D 3/283 83/699.51
1,809,824 A * 6/1931 Bader ..... B26D 1/25 83/697
2,480,717 A * 8/1949 Dodegge ..... B26D 3/283 83/699.61
2,766,793 A * 10/1956 Duszynski ..... B26D 3/283 83/699.51
3,509,926 A * 5/1970 Morris ..... B26D 1/25 83/648

* cited by examiner

*Primary Examiner* — Andrea L Wellington
*Assistant Examiner* — Liang Dong
(74) *Attorney, Agent, or Firm* — Prakash Nama; Global IP Services, PLLC

(57) ABSTRACT

A mandoline slicer including a frame having two opposed side walls and a food support surface, a blade assembly, and a slicing thickness adjustment mechanism engaging the blade assembly with the frame and configured to vertically move the blade assembly relative to the food support surface between an operating position where the cutting blade is exposed above the food support surface for a vertical distance for slicing and a resting position where the cutting blade is positioned coplanar with or below the food support surface. The present invention has a fixed and integral food support surface and a movable blade assembly which is easy and safe to operate. It can provide bi-directional food slicing as well as bi-directional julienne blade slicing of food.

4 Claims, 5 Drawing Sheets

MANDOLINE SLICER

BACKGROUND OF THE INVENTION

The present invention relates to a food preparation item and more specifically pertains to a mandoline slicer.

Conventional mandoline slicers allow varying thickness slice capability via adjustment of the food support surface relative to the cutting blade. This relies on the relatively large area of the food support surface. The slicing thickness adjustment operation may not be easy to set correctly and can be cumbersome. Correct positioning of the food support surface relative to the cutting blade requires careful operation and the food support surface is not fixed in place but rests, via gravity, on a moving support component. Thus it is easy for the cutting blade to injure users if the food support surface is unintentionally positioned below the cutting blade.

BRIEF SUMMARY OF THE INVENTION

In view of the aforesaid disadvantages now present in the prior art, the object of the present invention is to provide a mandoline slicer with a fixed and integral food support surface and a movable blade assembly which is easy and safe to operate. The mandoline slicer of the present invention is capable of providing bi-directional food slicing so that sliding the food from the first end to the second end on the food support surface slices the food for the first time, and sliding the food from the second end back to the first end slices the food for the second time. Slicing efficiency is therefore increased. The present invention is also capable of providing double julienne blades so that bi-directional julienne slicing of food is possible, thus enhancing production efficiency.

To attain this, the mandoline slicer of the present invention comprises a frame, a blade assembly and a slicing thickness adjustment mechanism. The frame has two opposed side walls and a food support surface positioned between the two opposed side walls. A blade opening is provided on the food support surface. The blade assembly is mounted with a cutting blade thereon and movably received within the frame. The slicing thickness adjustment mechanism engages the blade assembly with the frame and is configured to vertically move the blade assembly relative to the food support surface between an operating position where the cutting blade is exposed above the food support surface for a vertical distance for slicing and a resting position where the cutting blade is positioned coplanar with or below the food support surface.

The vertical distance between the cutting blade and the food support surface is adjustable by the slicing thickness adjustment mechanism.

The blade assembly is spring-loaded to be biased away from the food support surface.

The slicing thickness adjustment mechanism is a cam mechanism cooperating with at least one knob so that rotation of the knob synchronously moves the blade assembly between the operating position and the resting position. More specifically, the blade assembly comprises two opposed blade assembly side walls and a blade seat positioned between the two opposed blade assembly side walls for receiving the cutting blade, and each of the two opposed blade assembly side walls has a corresponding notch at a lower side thereof; the slicing thickness adjustment mechanism comprises a blade assembly axle which passes through two corresponding blade assembly axle openings at the two side walls so that each of a first end and a second end of the blade assembly axle protrudes outward from the corresponding side wall and connects to a knob rotatably mounted at the corresponding side wall; an eccentric cam is provided near each of the first and the second end of the blade assembly axle, wherein the eccentric cams are configured to abut against the notches so as to overcome the spring biasing force exerted to the blade assembly and move the blade assembly. The blade assembly axle has a cross section in shape of a square; each of the eccentric cams has a quadrilateral cross section so that rotation of the knobs causes rotation of the eccentric cams to move the blade assembly among a first operating position where a first side of each of the eccentric cams abuts against the corresponding notch and the cutting blade is exposed above the food support surface for a first vertical distance, a second operating position where a second side of each of the eccentric cams abuts against the corresponding notch and the cutting blade is exposed above the food support surface for a second vertical distance, a third operating position where a third side of each of the eccentric cams abuts against the corresponding notch and the cutting blade is exposed above the food support surface for a third vertical distance, and the resting position where a fourth side of each of the eccentric cams abuts against the corresponding notch.

The cutting blade has one or two longitudinal cutting edges for uni-directional or bi-directional food slicing.

The mandoline slicer of the present invention further comprises a julienne blade assembly which is movably received within the blade assembly and mounted with at least one julienne blade thereon; and a julienne blade activating mechanism which engages the julienne blade assembly with the blade assembly and is configured to vertically move the julienne blade assembly relative to the blade assembly between a raised position and a lowered position, so that when the blade assembly is at the resting position, the julienne blade is positioned below the food support surface in both the raised position and the lowered positioned, and when the blade assembly is at the operating position, the julienne blade is positioned below the food support surface in the lowered position and is exposed above the food support surface in the raised position.

The julienne blade assembly is spring-loaded to be biased away from the food support surface. It comprises a first end and a second end with a longitudinal opening between the first end and the second end for the cutting blade to pass through, and a pair of opposed julienne blade seats arranged parallel and adjacent to two longitudinal sides of the longitudinal opening for receiving the julienne blades.

The julienne blade activating mechanism comprises a first pair of julienne blade moving means connected in synchronous driving relationship at two ends of a first julienne blade axle and engaging below the first end of the julienne blade assembly, and a second pair of julienne blade moving means connected in synchronous driving relationship at two ends of a second julienne blade axle and engaging below the second end of the julienne blade assembly; the first pair of julienne blade moving means and the second pair of julienne blade moving means are connected in synchronous driving relationship; one of first pair of julienne blade moving means is rotatable by a lever rotatably mounted at one of the side walls of the frame, so that rotation of the lever drives rotation of the first and the second pairs of julienne blade moving means to move the julienne blade assembly between the raised position and the lowered position.

The julienne blade activating mechanism further comprises a first guide rail and a second guide rail provided at two inner sides of the blade assembly side walls respectively; a first end of the first guide rail and a first end of the second guide rail engage with the first pair of julienne blade moving means respectively; a second end of the first guide rail and a second end of the second guide rail engage with the second pair of julienne blade moving means respectively; each of the julienne blade moving means has a pinion portion; each of the first and the second ends of the first and the second guide rails has a rack portion which cooperates with the pinion portion of the corresponding julienne blade moving means, so that rotation of the lever drives synchronous rotation of the first pair of julienne blade moving means and the second pair of julienne blade moving means.

The first guide rail is provided with a guide opening at the second end thereof; the second guide rail is provided with a guide opening at the second end thereof; the guide opening each corresponds to a stud protruded from the inner side of the blade assembly side wall; the studs are configured to move from one side of the guide openings to another when the julienne blade assembly is moved between the raised position and the lowered position.

Each of the julienne blade moving means has an outwardly extending cam portion in a shape resembling of a letter "D" with a shorter horizontal upper edge and a longer vertical side edge connected to each other by an arc; the longer vertical side edge abuts against the julienne blade assembly at the lowered position; the shorter horizontal upper edge abuts against the julienne blade assembly at the raised position.

Each of the julienne blade seats is arranged with a julienne blade with cutting edge of the julienne blade facing outward from the longitudinal opening.

DETAILED DESCRIPTION OF THE INVENTION

The present invention is further described in detail with the following embodiment and the accompanying drawings.

Figure 1:
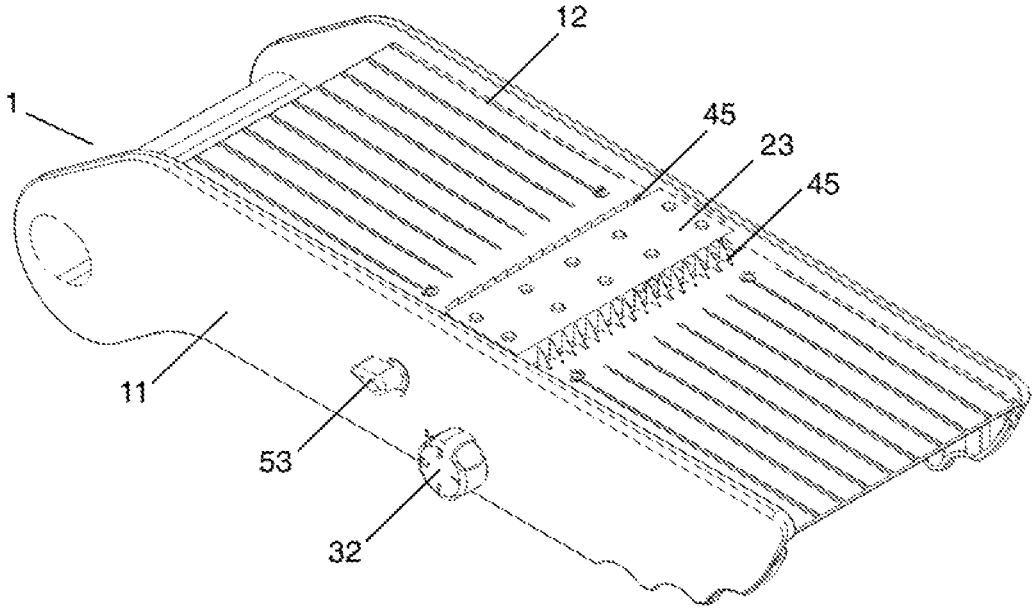
FIG. 1 is a perspective view of a preferred embodiment of the present invention.
Figure 2:
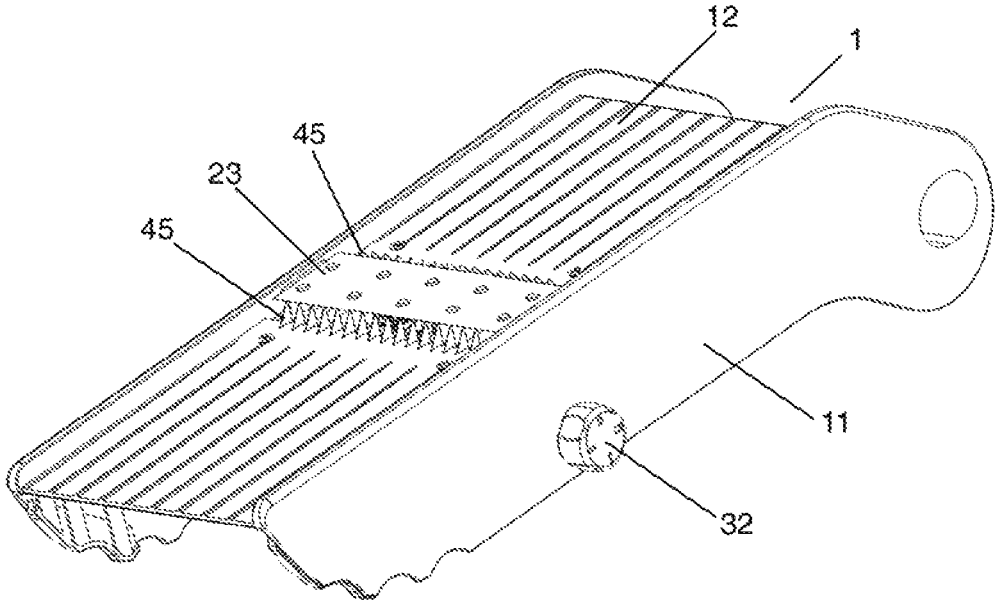
FIG. 2 is another perspective view of the preferred embodiment as shown in FIG. 1.
Figure 3:
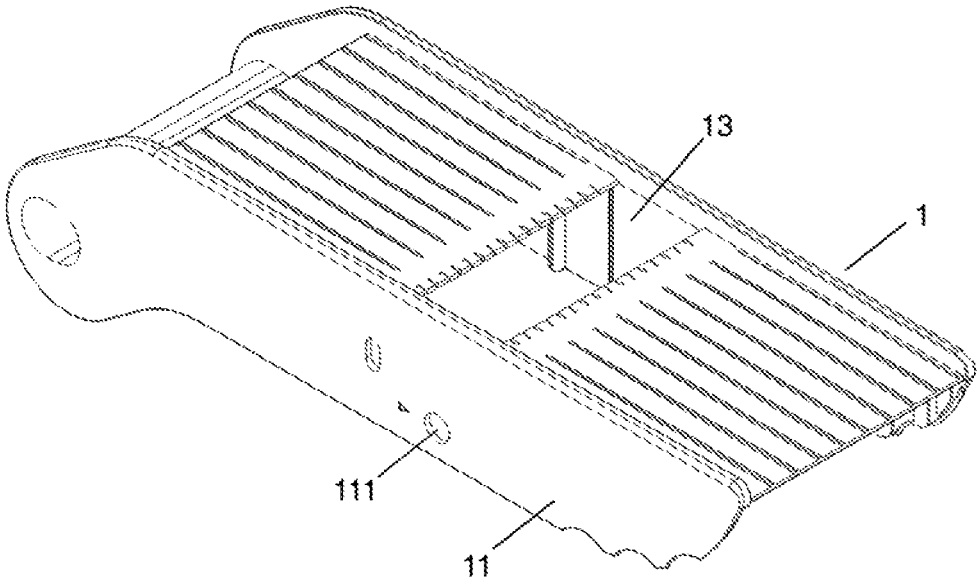
FIG. 3 is a perspective view of the frame of the preferred embodiment as shown in FIG. 1.
Figure 4:
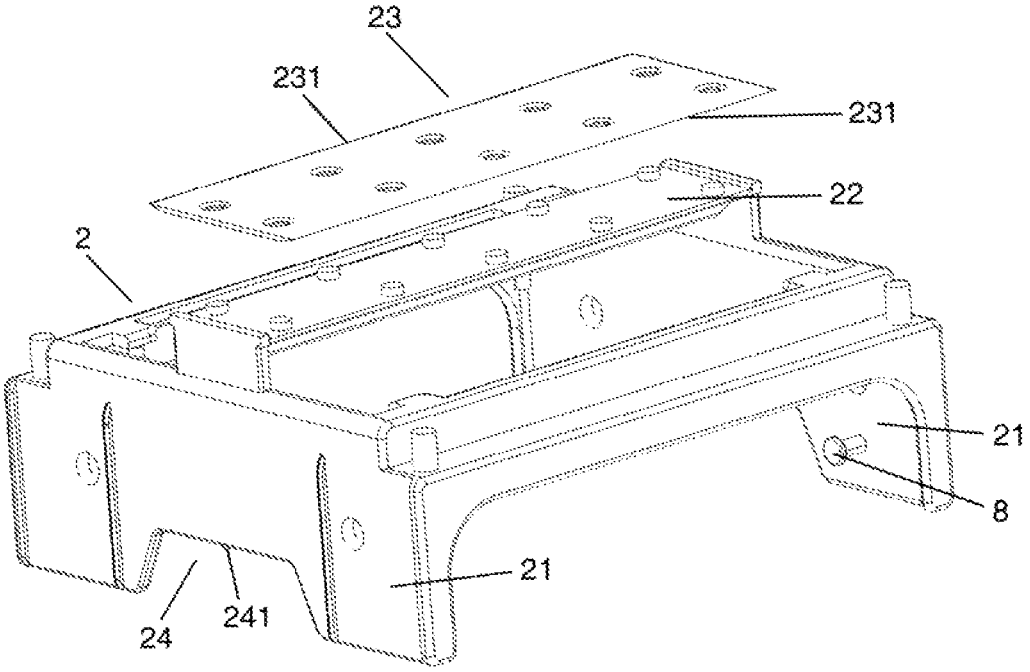
FIG. 4 is another perspective view of the blade assembly and the cutting blade of the preferred embodiment as shown in FIG. 1.
Figure 5:
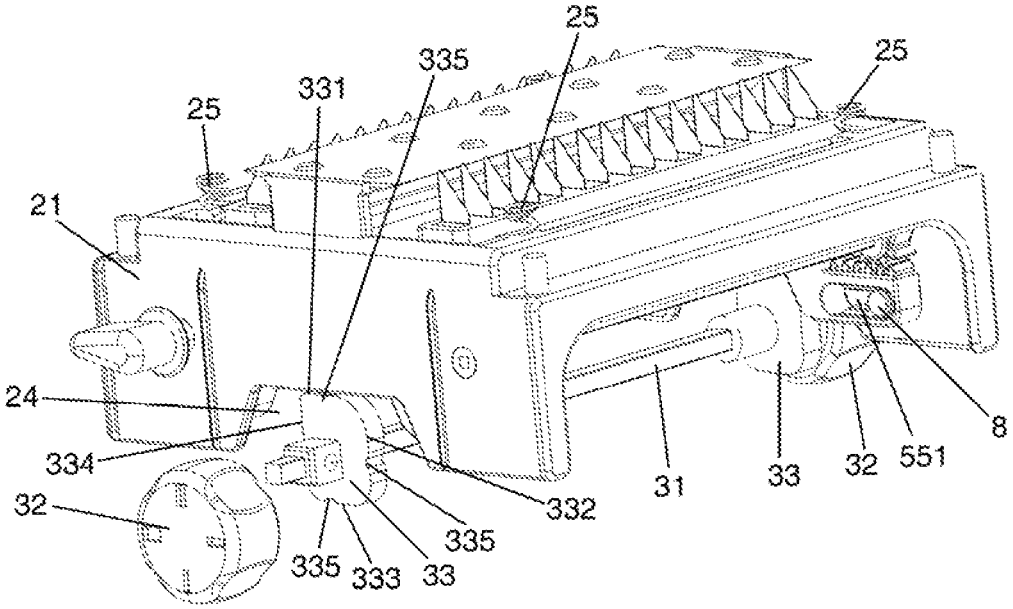
FIG. 5 is a perspective view of the slicing thickness adjustment mechanism in cooperation with the blade assembly of the preferred embodiment as shown in FIG. 1.
Figure 6:
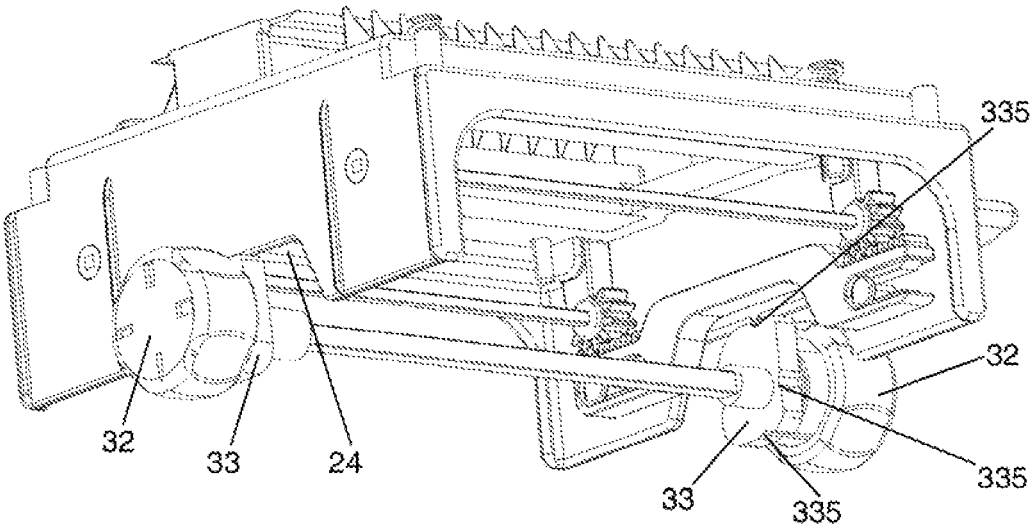
FIG. 6 is another perspective view of the slicing thickness adjustment mechanism in cooperation with the blade assembly of the preferred embodiment as shown in FIG. 1.
Figure 7:
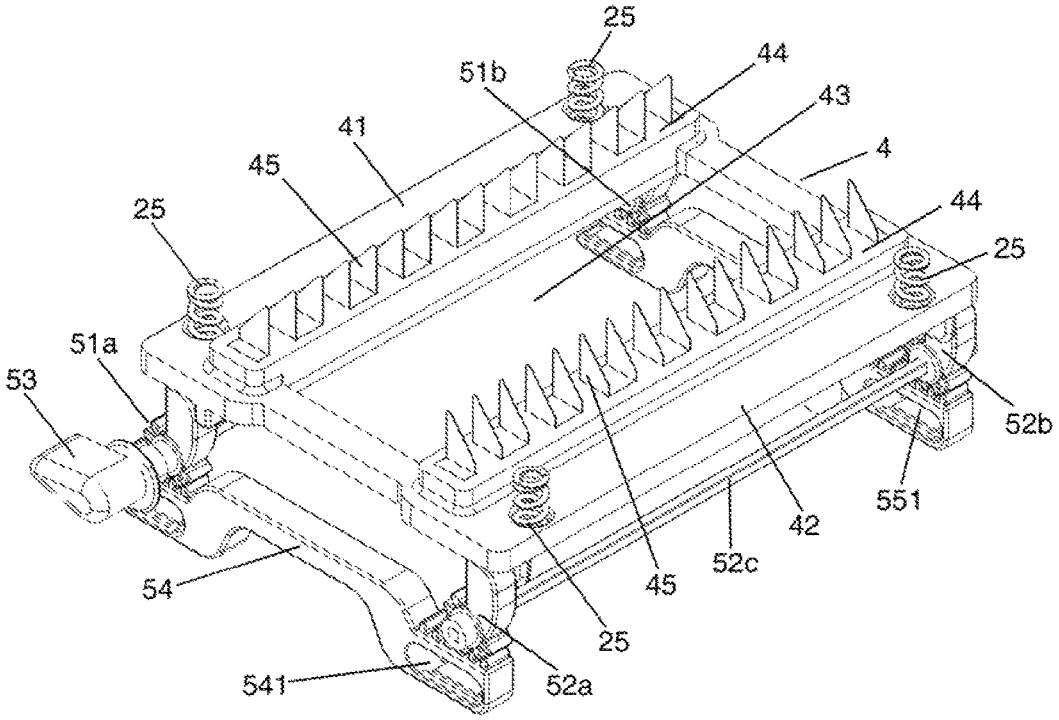
FIG. 7 is a perspective view of the julienne blade activating mechanism in cooperation with the julienne blade assembly of the preferred embodiment as shown in FIG. 1.
Figure 8:
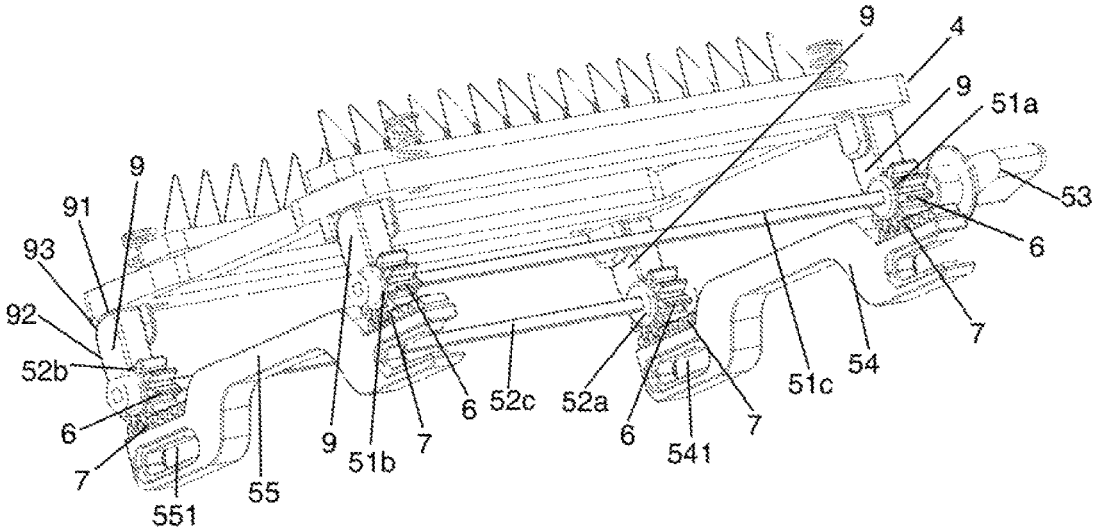
FIG. 8 is another perspective view of the julienne blade activating mechanism in cooperation with the julienne blade assembly of the preferred embodiment as shown in FIG. 1.
Figure 9:
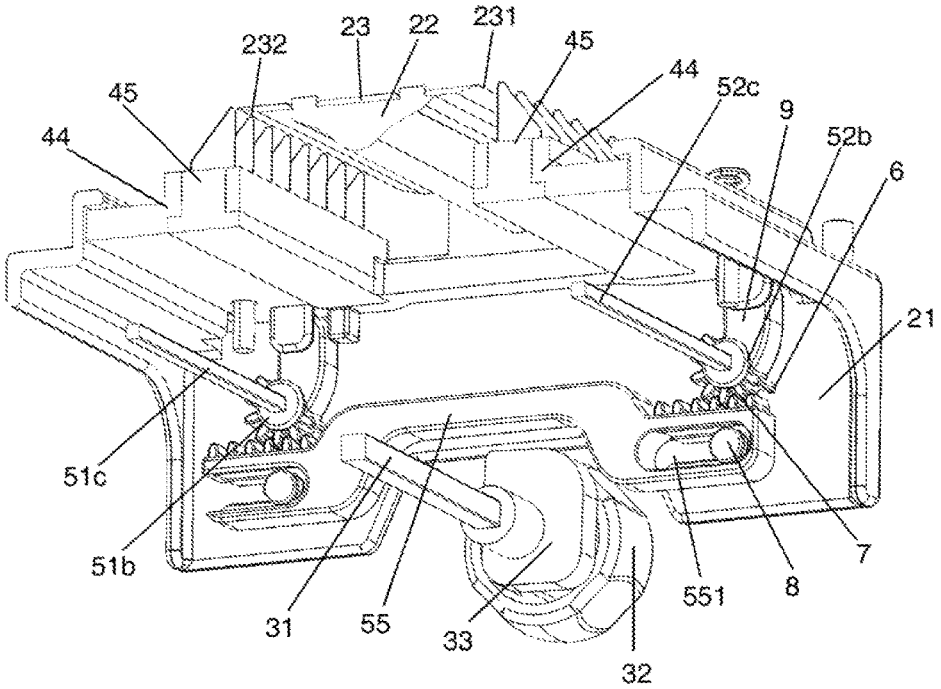
FIG. 9 is a cross sectional perspective view of the julienne blade activating mechanism, the julienne blade assembly and the blade assembly of the preferred embodiment as shown in FIG. 1.

As illustrated in FIGS. 1-9, a preferred embodiment of the mandoline slicer of the present invention comprises a frame 1, a blade assembly 2 and a slicing thickness adjustment mechanism 3, a julienne blade assembly 4 and a julienne blade activating mechanism 5.

The frame 1 has two opposed side walls 11 and a food support surface 12 positioned between the two opposed side walls 11. The frame 1 is preferably integrally formed as a whole for improved rigidity and reliability. A blade opening 13 is provided on the food support surface 12.

The blade assembly 2 is movably received within the frame 1 and comprises two opposed blade assembly side walls 21 and a blade seat 22 positioned between the two opposed blade assembly side walls 21 for receiving a cutting blade 23. The cutting blade 23 has two longitudinal cutting edges 231 to provide bi-directional food slicing function. In other embodiments, it is also possible for the cutting blade 23 to have only one longitudinal cutting edge to provide uni-directional food slicing. The cutting blade 23 may be mounted to the blade seat 22 by conventional fastening mechanism. Each of the opposed assembly side walls 21 has a corresponding notch 24 at a lower side thereof. Four springs 25 are disposed on a top side of the blade assembly 2 and abut against the food support surface 12 to bias the blade assembly 2 away from the food support surface 12.

The slicing thickness adjustment mechanism comprises a blade assembly axle 31 which passes through two corresponding blade assembly axle openings 111 at the two side walls 11 so that each of a first end and a second end of the blade assembly axle 31 protrudes outward from the corresponding side wall 11 and connects to a knob 32 rotatably mounted at the corresponding side wall 11. An eccentric cam 33 is provided near each of the first end and the second end of the blade assembly axle 31, wherein the eccentric cams 33 are configured to abut against the notches 24 so as to overcome the spring biasing force exerted by the springs 25 to the blade assembly 2 and move the blade assembly 2.

In this embodiment, the blade assembly axle 31 has a cross section in shape of a square. Each of the eccentric cams 33 has a quadrilateral cross section so that rotation of the knobs 32 causes rotation of the eccentric cams 33 to move the blade assembly 2 vertically relative to the food support surface 12 among a first operation position where a first side 331 of each of the eccentric cams 33 abuts against the corresponding notch 24 and the cutting blade 23 is exposed above the food support surface 12 for a first vertical distance (which is 6 mm in this embodiment), a second operating position where a second side 332 of each of the eccentric cams 33 abuts against the corresponding notch 24 and the cutting blade 23 is exposed above the food support surface 12 for a second vertical distance (which is 4 mm in this embodiment), a third operating position where a third side 333 of each of the eccentric cams 33 abuts against the corresponding notch 24 and the cutting blade 23 is exposed above the food support surface 12 for a third vertical distance (which is 2 mm in this embodiment), and a resting position where a fourth side 334 of each of the eccentric cams 33 abuts against the corresponding notch 24 and the cutting blade 23 is positioned coplanar with or below the food support surface 12. In this embodiment, an indentation 335 is provided on each of the first side 331, the second side 332, the third side 333 and the fourth side 334 of one of the eccentric cams 33 which corresponds to a protrusion 241 on the notch 24 so as to fix the blade assembly 2 at the first operating position, the second operating position, the third operating position and the resting position respectively.

The julienne blade assembly 4 comprises a first end 41 and a second end 42 with a longitudinal opening 43 between the first end 41 and the second end 42 for the cutting blade 23 to pass through. A pair of opposed julienne blade seats 44 is arranged parallel and adjacent to two longitudinal sides of the longitudinal opening 43. Each of the julienne blade seats 44 receives a julienne blade 45. The four springs 25 disposed on the top side of the blade assembly 2 also passes through the julienne blade assembly 4 to bias the julienne blade assembly 4 away from the food support surface 12.

The julienne blade activating mechanism comprises a first pair of julienne blade moving means 51*a*, 51*b*, a second pair of julienne blade moving means 52*a*, 52*b*, a lever 53, a first guide rail 54 and a second guide rail 55.

The first pair of julienne blade moving means 51*a*, 51*b* is connected in synchronous driving relationship at two ends of a first julienne blade axle 51*c* and engaging below the first end 41 of the julienne blade assembly 4. The second pair of julienne blade moving means 52*a*, 52*b* is connected in synchronous driving relationship at two ends of a second julienne blade axle 52*c* and engaging below the second end 42 of the julienne blade assembly 4.

One of the first pair of julienne blade moving means 51*a* is rotatable by the lever 53 rotatably mounted at one of the side walls 11 of the frame 1.

The first guide rail 54 and the second guide rail 55 are provided at two inner sides of the blade assembly side walls 21 respectively. A first end of the first guide rail 54 and a first end of the second guide rail 55 engage with the first pair of julienne blade moving means 51*a*, 51*b* respectively. A second end of the first guide rail 54 and a second end of the second guide rail 55 engage with the second pair of julienne blade moving means 52*a*, 52*b* respectively. Each of the julienne blade moving means 51*a*, 51*b*, 52*a*, 52*b* has a pinion portion 6. Each of the first and the second ends of the first and the second guide rails 54, 55 has a rack portion 7 which cooperates with the pinion portion 6 of the corresponding julienne moving means 51*a*, 51*b*, 52*a*, 52*b*, so that rotation of the lever 53 drives synchronous rotation of the first pair of julienne blade moving means 51*a*, 51*b* and the second pair of julienne blade moving means 52*a*, 52*b* to vertically move the julienne blade assembly 4 relative to the blade assembly 2 between a raised position and a lowered position, so that when the blade assembly 2 is at the resting position, the julienne blades 45 are positioned below the food support surface 12 in both the raised position and the lowered positioned, and when the blade assembly 2 is at the operating position, the julienne blades 45 are positioned below the food support surface 12 in the lowered position and are exposed above the food support surface 12 in the raised position. Therefore, the julienne blades 45 are kept below the food support surface 12 at the resting position, so that the julienne blades 45 will not be exposed to injure users when the mandoline slicer is not in use. The user may also select to use the mandoline slicer with or without the julienne blades 45 by moving the julienne blade assembly 4 to the raised position and the lowered position respectively.

In this embodiment, each of the julienne blade moving means 51*a*, 51*b*, 52*a*, 52*b* has an outwardly extending cam portion 9 in a shape resembling of a letter "D" with a shorter horizontal upper edge 91 and a longer vertical side edge 92 connected to each other by an arc 93. The longer vertical side edge 92 abuts against the julienne blade assembly 4 at the lowered position. The shorter horizontal upper edge 91 abuts against the julienne blade assembly 4 at the raised position. The first guide rail 54 is provided with a guide opening 541 at the second end thereof; the second guide rail 55 is provided with a guide opening 551 at the second end thereof. The guide opening 541, 551 each corresponds to a stud 8 protruded from the inner side of the blade assembly side wall 21. The studs 8 are configured to move from one side of the guide openings 541, 551 to the other when the julienne blade assembly 4 is moved between the raised position and the lowered position.

It should be noted that while the present embodiment is provided with two julienne blades, it is possible to provide only one julienne blade if intended. It is also possible to provide a mandoline slicer without the julienne blade assembly and the julienne blade activating mechanism in accordance with the present invention. The slicing thickness adjustment mechanism and the julienne blade activating mechanism may take other forms which are obvious to the person skilled in the art without departing from the scope of the present invention. Other additional features commonly found in conventional mandoline slicers such as hand guards, handles, grooves provided at a lower side of the frame for engaging the mandoline slicer to a bowl for receiving the sliced food and so forth may also be provided in the mandoline slicer of the present invention.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A mandoline slicer, comprising:

a frame having two opposed side walls and a food support surface positioned between the two opposed side walls;

a blade opening provided on the food support surface;

a blade assembly which is mounted with a cutting blade thereon and movably received within the frame;

a slicing thickness adjustment mechanism engaging, the blade assembly with the frame and configured to vertically move the blade assembly relative to the food support surface between an operating position where the cutting blade is exposed above the food support surface for a vertical distance for slicing and a resting position where the cutting blade is positioned coplanar with or below the food support surface;

the blade assembly is spring-loaded by springs disposed on a top side of the blade assembly and abutting against the food support surface to bias the blade assembly away from the food support surface when the blade assembly is in the resting position;

the blade assembly comprises two opposed blade assembly side walls and a blade seat positioned between the two opposed blade assembly side walls for receiving the cutting blade, and each of the two opposed blade assembly side walls has a corresponding notch at a lower side thereof; the slicing thickness adjustment mechanism comprises a blade assembly axle which passes through two corresponding blade assembly axle openings at the two side walls so that each of a first end and a second end of the blade assembly axle protrudes outward from the corresponding side wall and connects to a knob rotatably mounted at the corresponding side wall; an eccentric cam is provided near each of the first and the second end of the blade assembly axle, wherein the eccentric cams are configured to abut against the notches so as to overcome the spring biasing force exerted to the blade assembly and move the blade assembly.

2. The mandoline slicer as in claim 1, wherein the vertical distance between the cutting blade and the food support surface is adjustable by the slicing thickness adjustment mechanism.

3. The mandoline slicer as in claim 1, wherein the blade assembly axle has a cross section in shape of a square; each of the eccentric cams has a quadrilateral cross section so that rotation of the knobs causes rotation of the eccentric cams to move the blade assembly among a first operating position where a first side of each of the eccentric cams abuts against the corresponding notch and the cutting blade is exposed above the food support surface for a first vertical distance, a second operating position where a second side of each of the eccentric cams abuts against the corresponding notch and the cutting blade is exposed above the food support surface for a second vertical distance, a third operating position where a third side of each of the eccentric cams abuts against the corresponding notch and the cutting blade is exposed above the food support surface for a third vertical distance, and the resting position where a fourth side of each of the eccentric cams abuts against the corresponding notch.

4. The mandoline slicer as in claim 1, wherein the cutting blade has one or two longitudinal cutting edges for uni-directional or bi-directional food slicing.

* * * * *